US008424589B2

(12) United States Patent
McMillan et al.

(10) Patent No.: US 8,424,589 B2
(45) Date of Patent: Apr. 23, 2013

(54) MOTORCYCLE OIL COOLER

(76) Inventors: George Erik McMillan, Hickory, NC (US); Scott L. Lowe, Conover, NC (US)

( * ) Notice: Subject to any disclaimer, the term of this patent is extended or adjusted under 35 U.S.C. 154(b) by 1267 days.

(21) Appl. No.: 12/173,779

(22) Filed: Jul. 15, 2008

(65) Prior Publication Data

US 2009/0020261 A1 Jan. 22, 2009

Related U.S. Application Data

(60) Provisional application No. 60/950,070, filed on Jul. 16, 2007.

(51) Int. Cl.
*F28F 13/12* (2006.01)

(52) U.S. Cl.
USPC ..... 165/41; 165/271; 165/51; 165/122; 180/229; 180/68.4; 123/196 AB

(58) Field of Classification Search ..... 165/271, 165/51, 41, 44, 122; 476/14; 180/229, 68.4, 180/68.6
See application file for complete search history.

(56) References Cited

U.S. PATENT DOCUMENTS

| | | | | |
|---|---|---|---|---|
| 3,270,805 | A * | 9/1966 | Glucksman | 165/122 |
| 4,170,377 | A * | 10/1979 | Ingram | 296/180.5 |
| 4,171,937 | A * | 10/1979 | Greenfield | 417/423.15 |
| 4,295,964 | A | 10/1981 | Preisler | |
| 4,662,470 | A | 5/1987 | Fujisawa et al. | |
| 4,671,781 | A * | 6/1987 | Tanaka et al. | 474/93 |
| 5,244,036 | A | 9/1993 | Michl | |
| 5,901,808 | A | 5/1999 | Swenson et al. | |
| 6,267,700 | B1 * | 7/2001 | Takayama | 474/93 |
| 6,871,628 | B1 | 3/2005 | Tauer | |
| 6,955,150 | B2 | 10/2005 | Moss | |
| 6,994,150 | B1 | 2/2006 | Kline | |
| 2004/0224806 | A1 * | 11/2004 | Chonan | 474/93 |

* cited by examiner

*Primary Examiner* — Frantz Jules
*Assistant Examiner* — Alexandro Acevedo Torres
(74) *Attorney, Agent, or Firm* — Muncy, Geissler, Olds & Lowe PLLC

(57) ABSTRACT

An oil cooler for a motorcycle includes a heat exchanger residing within a primary drive between an engine pulley and a clutch pulley. A fan within the primary drive pushes or pulls air through the heat exchanger. The fan may be electrically or mechanically operated and mounted to one of a base plate or a cover plate of the primary drive. Alternatively, the fan may be formed as a mechanical portion of one of the primary drive components. Vectoring blades may assist in directing an air flow within the primary drive to the heat exchanger, and vents may be formed in the cover plate for air intake and/or exhaust.

13 Claims, 10 Drawing Sheets

MOTORCYCLE OIL COOLER

This application claims the benefit of U.S. Provisional Application No. 60/950,070, filed Jul. 16, 2007, the entire contents of which are herein incorporated by reference.

BACKGROUND OF THE INVENTION

1. Field of the Invention

The present invention relates to a motorcycle. More particularly, the present invention relates to an oil cooler located in a primary drive unit of the motorcycle and to a fan unit which can provide a cooling air flow.

2. Description of the Related Art

An air-cooled engine of a motorcycle typically has a separate oil cooler. Oil is pumped through the oil cooler, where it is cooled and then passes back to the engine. The most common form of a motorcycle oil cooler is a rectangular structure mounted to front frame members of the motorcycle. FIGS. 1-4 illustrate typical prior art oil cooler structures and their placement on a motorcycle frame. For more detail about the function and structure of a motorcycle oil cooler, reference can be had to one or more of U.S. Pat. Nos. 4,295,964; 4,662,470; 5,244,036 and 5,901,808, each of which is herein incorporated by reference.

Having an oil cooler placed on the front frame of the motorcycle is particularly advantageous in that the oil cooler resides in an air stream created by movement of the motorcycle as it travels along a road. Thus, the oil cooler can receive a cooling air flow which is used to reduce the temperature of oil passing through the oil cooler. Hence, the efficiency of the oil cooler is improved by this frontal, mostly unobstructed placement on the motorcycle.

Drawbacks have been appreciated as to having the oil cooler on the front of the motorcycle. One drawback is that the oil cooler is subject to damage from road debris (e.g. rocks, sand, bugs, trash) which can directly impact the cooling fins of the oil cooler from the roadway or get kicked up into the air by the front tire and impact the oil cooler. Such impacts can damage the oil cooler unit and lead to reduced cooling efficiency (e.g., a bent or clogged cooling fin) or engine overheating and damage (e.g., a broken or closed tube within the cooling unit).

Another appreciated drawback is that air flow through the oil cooler ceases when the motorcycle is stationary (e.g., stopped at a traffic light, stuck in traffic, slowly cruising along a beachfront street with a very slow speed limit like 5 mph). In fact, an oil cooler which produces a satisfactory drop of perhaps 20 degrees Fahrenheit in engine oil temperature when the motorcycle is traveling at road speeds, might produce an engine oil temperature drop of only 2 to 4 degrees Fahrenheit when the motorcycle is idling along in heavy traffic conditions. Such an oil temperature reduction is insufficient and can lead to engine overheating, damage and failure.

Another appreciated drawback is that the appearance of a custom motorcycle is very important to the purchaser/owner. An oil cooler typically has many complex surfaces (e.g. cooling fins or coils). Hence it is difficult to keep clean. Also because the oil cooler is very hot and sometimes splashed with water (e.g., rain), chroming on an oil cooler often becomes discolored with a blue or brown hue. Also, the oil lines to and from the oil cooler at the front of the motorcycle can be distracting to the overall appearance of the motorcycle and detract from the overall sleek appearance of the motorcycle.

Therefore, it has been desirable to hide the oil cooler on the motorcycle. One such approach to hide the oil cooler can be seen in U.S. Pat. No. 5,244,036. The solution of U.S. Pat. No. 5,244,036 is illustrated in FIG. 5, where the oil cooler is disguised as a more decorative front member, and might appeal to some riders as a spring-like structure. Further, the incoming and outgoing oil lines are moved to point very low on the motorcycle so as to not be distracting. However, the design of FIG. 5 still has drawbacks. The complex surfaces of the oil cooler are still visible and must be cleaned, the performance of the oil cooler still drops dramatically when the motorcycle stops moving, and some purchasers/owners may not desire this "springer" styling approach of hiding the oil cooler.

Another solution to hide the oil cooler can be seen in U.S. Pat. No. 6,871,628, which is herein incorporated by reference, and illustrated in FIGS. 6 and 7. In FIGS. 6 and 7, the oil cooler has been incorporated as a "snaked" pathway 60 formed within an outer cover plate 50 of an engine primary drive 14, which connects a V-twin engine 10 to a transmission 12.

Yet another solution to hide the oil cooler and to also place it in a position to receive a greater air flow can be seen in U.S. Pat. No. 6,994,150, which is herein incorporated by reference, and illustrated in FIGS. 8 and 9. In FIGS. 8 and 9, the fins 18 of the oil cooler have been integrated into the engine guard 20.

U.S. Pat. No. 6,955,150, which is herein incorporated by reference, shows a motorcycle oil cooling unit 1, as illustrated in FIGS. 10-13. The oil cooling unit 1 is mounted to down tubes 2 at the front frame of the motorcycle. An electrically operated fan 3 is controlled by an oil temperature thermostat and operates to provide a supplemental air flow to a radiator style oil cooler 4 when the oil temperature exceeds an upper threshold value.

The solution of U.S. Pat. No. 6,955,150 improves the cooling ability of the oil cooler while the motorcycle is stationary. However, the oil cooler is still distanced from the engine and attached to the front frame. Hence, extra components of the oil cooler are not well hidden or integrated on the motorcycle and electrical wires and oil lines to and from the oil cooler are also visible and distracting.

SUMMARY OF THE INVENTION

It is an object of this invention to address one or more of the drawbacks of the prior art oil coolers and/or one or more of the Applicants' appreciated needs in the art.

In one embodiment of the present invention, an oil cooler for a motorcycle has improved cooling abilities, as compared to the prior art oil coolers, and/or is better hidden or completely hidden on the motorcycle so as to not distract from the overall design of the motorcycle; and/or can be fabricated using less expensive and fewer materials, as the oil cooler is not subject to view (e.g., need not be chromed) and is positioned close to the engine (e.g., needs very short oil lines).

Another aspect of the present invention is to utilize the internal space within a primary drive of a motorcycle to house a heat exchanger. This internal space is typically empty; however some motorcycle manufacturers have been known to place an oil filter or a rectifier in the internal space.

In a supplemental and/or alternative embodiment, the present invention provides a primary drive with component parts, which serve the dual function of a fan or blower.

These and other objects are accomplished by an oil cooler for a motorcycle including a heat exchanger residing within a primary drive between an engine pulley and a clutch pulley. A fan within the primary drive pushes or pulls air through the heat exchanger. The fan may be electrically or mechanically operated and mounted to one of a base plate or a cover plate of the primary drive. Alternatively, the fan may be formed as a mechanical portion of one of the primary drive components. Vectoring blades may assist in directing an air flow within the primary drive to the heat exchanger, and vents may be formed in the cover plate for air intake and/or exhaust.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF A PREFERRED EMBODIMENT

Figure 1:
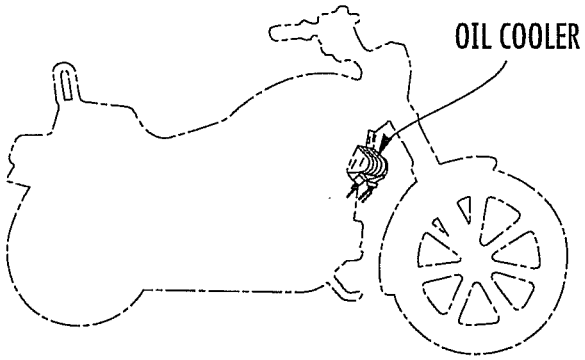
FIG. 1 (PRIOR ART)
FIG. 1 is a side view of a motorcycle with an oil cooler in accordance with a first embodiment of the prior art.
Figure 2:
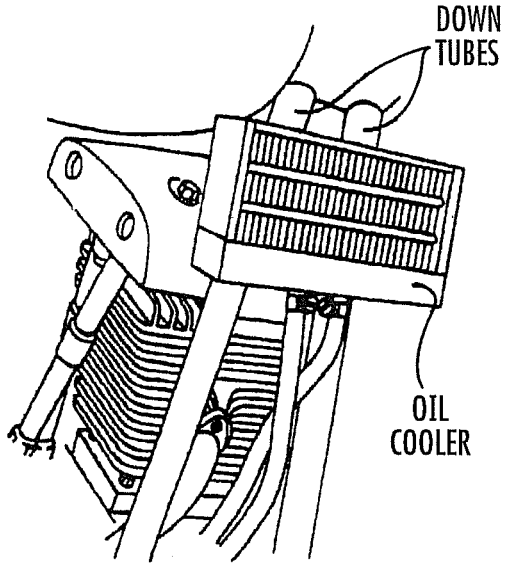
FIG. 2 (PRIOR ART)
FIG. 2 is a front perspective view of an oil cooler in accordance with a second embodiment of the prior art.
Figure 3:
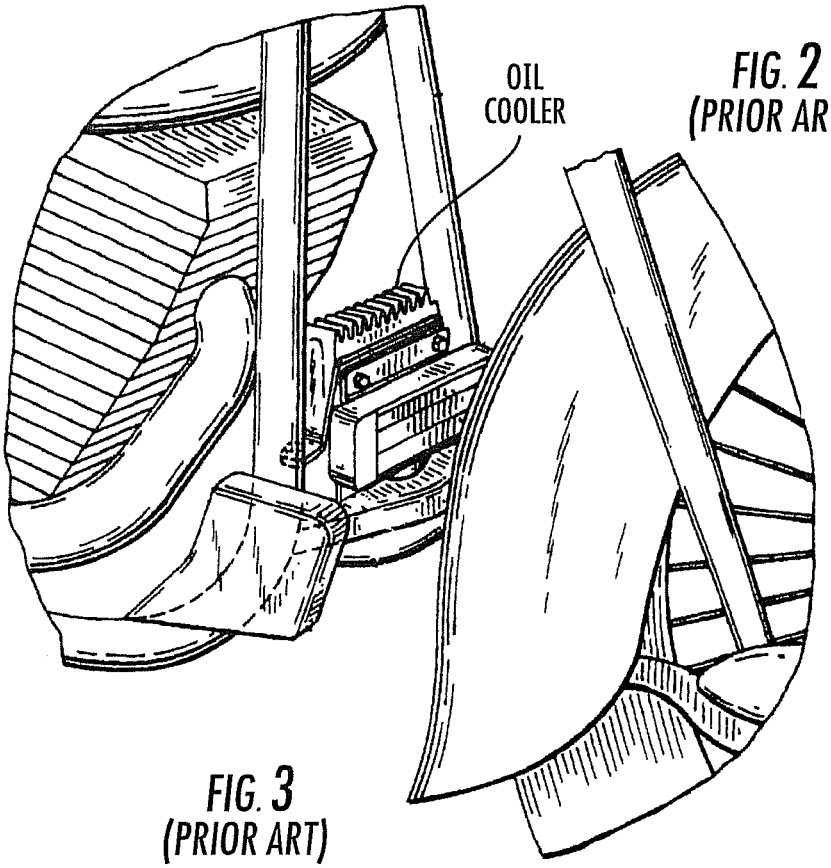
FIG. 3 (PRIOR ART)
FIG. 3 is a front perspective view of an oil cooler in accordance with a third embodiment of the prior art.
Figure 4:
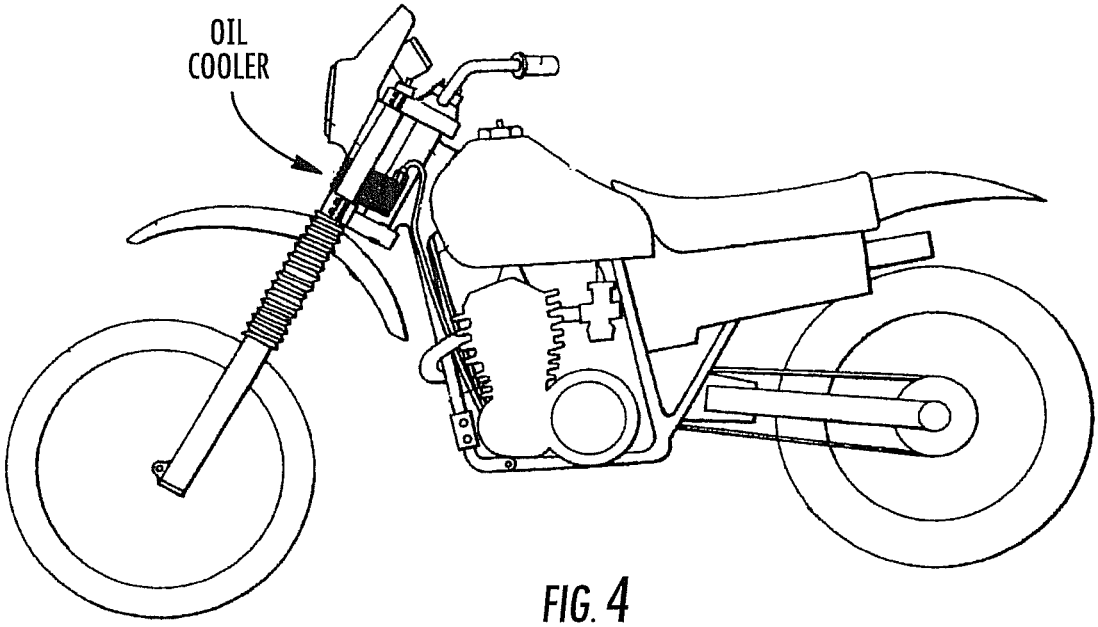
FIG. 4 (PRIOR ART)
FIG. 4 is a side view of a motorcycle with an oil cooler in accordance with a fourth embodiment of the prior art.
Figure 5:
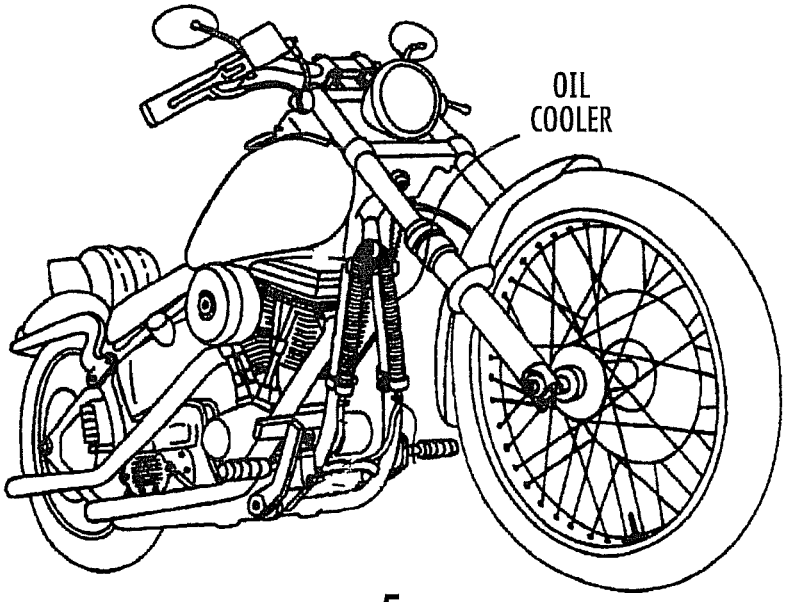
FIG. 5 (PRIOR ART)
FIG. 5 is a front perspective view of a motorcycle with an oil cooler in accordance with a fifth embodiment of the prior art.
Figure 6:
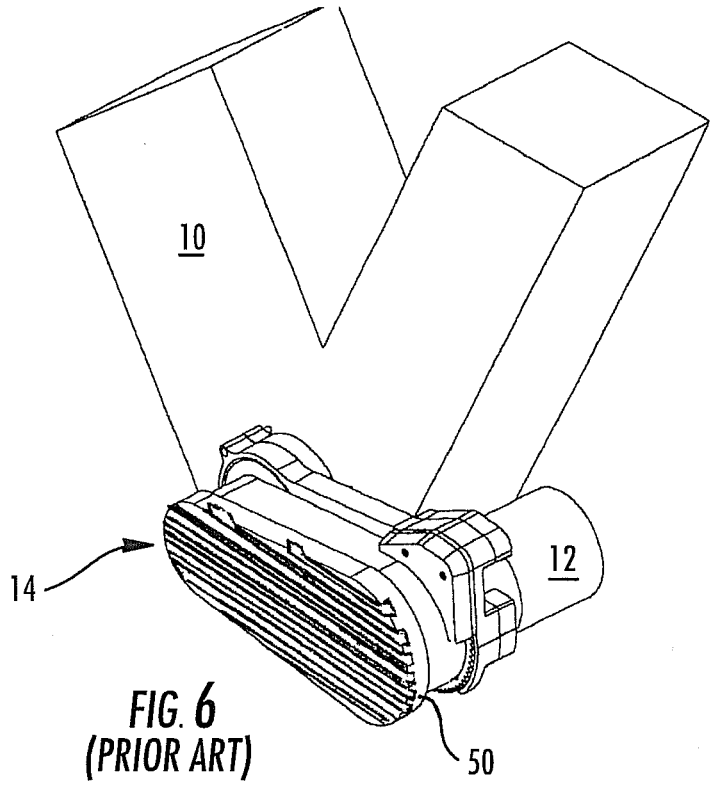
FIG. 6 (PRIOR ART)
FIG. 6 is a front perspective view of a motorcycle engine incorporating an oil cooler in accordance with a sixth embodiment of the prior art.
Figure 7:
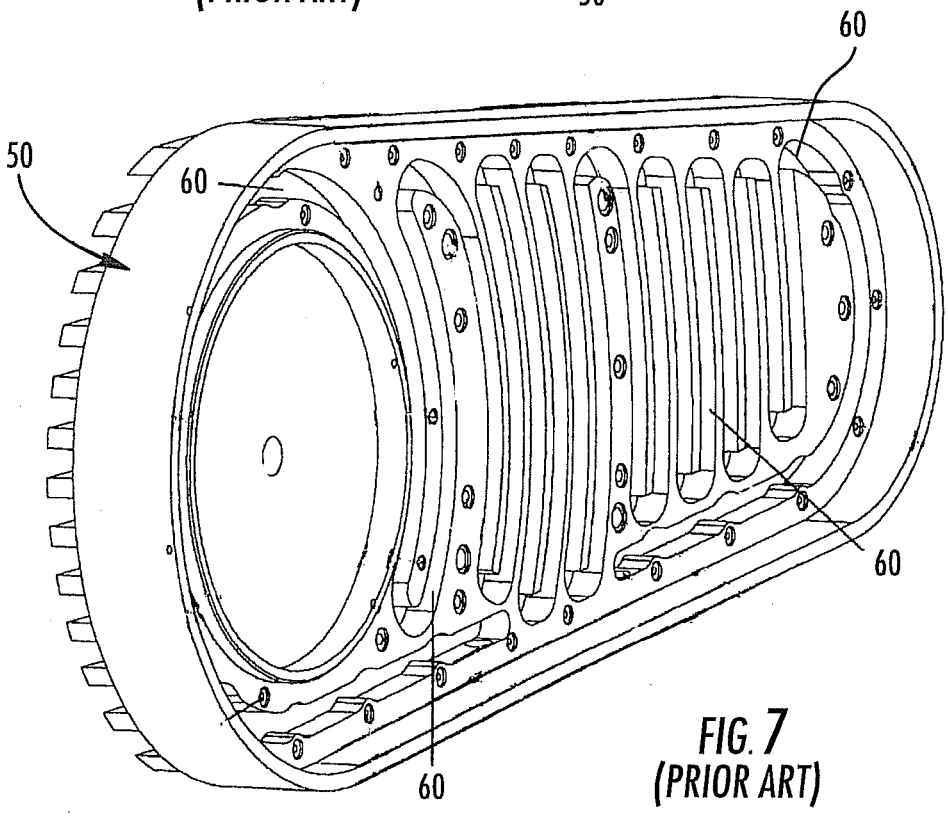
FIG. 7 (PRIOR ART)
FIG. 7 is a backside view of a primary drive cover of the motorcycle engine of FIG. 6.
Figure 8:
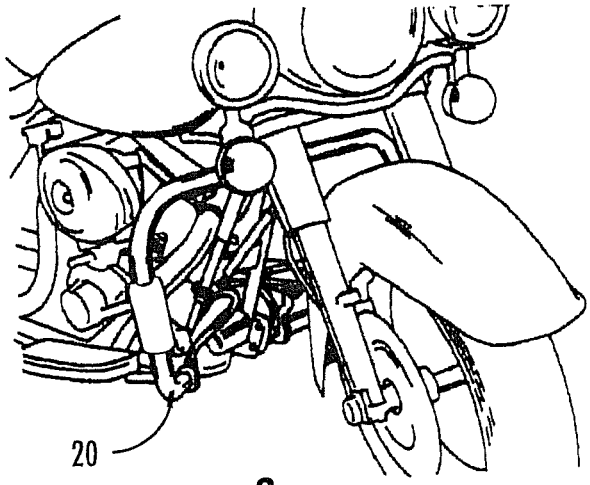
FIG. 8 (PRIOR ART)
FIG. 8 is a front perspective view of a motorcycle with an oil cooler in accordance with a seventh embodiment of the prior art.
Figure 9:
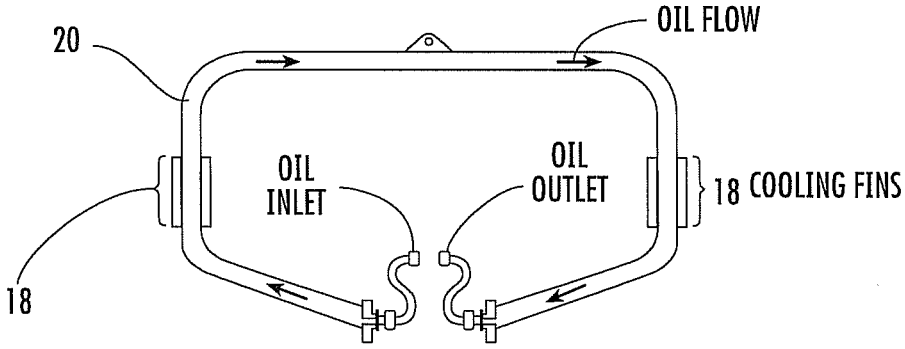
FIG. 9 (PRIOR ART)
FIG. 9 is a front view of the engine guard in FIG. 8, which includes the oil cooler.
Figure 11:
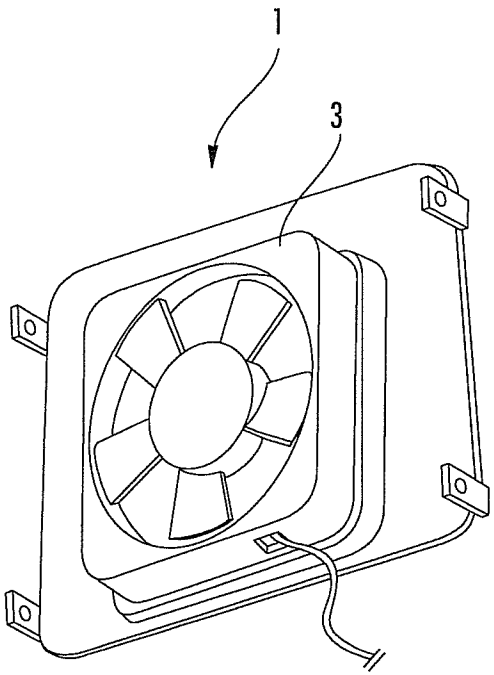
FIG. 11 (PRIOR ART)
FIG. 11 is a front perspective view of the oil cooler of FIG. 10.
Figure 10:
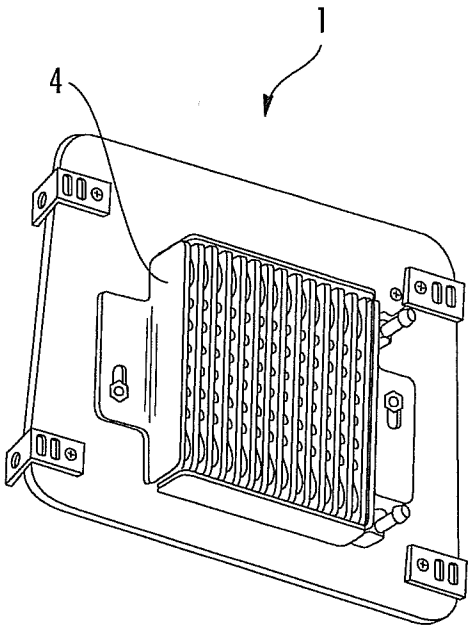
FIG. 10 (PRIOR ART)
FIG. 10 is a back perspective view of a fan assisted oil cooler in accordance with an eighth embodiment of the prior art.
Figure 12:
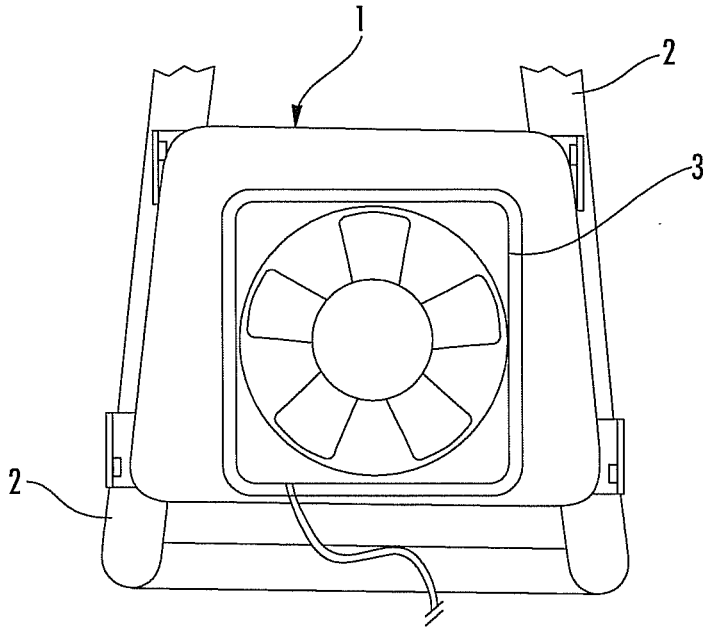
FIG. 12 (PRIOR ART)
FIG. 12 is a front view of the oil cooler of FIGS. 10-11 mounted to down tubes of a motorcycle.
Figure 13:
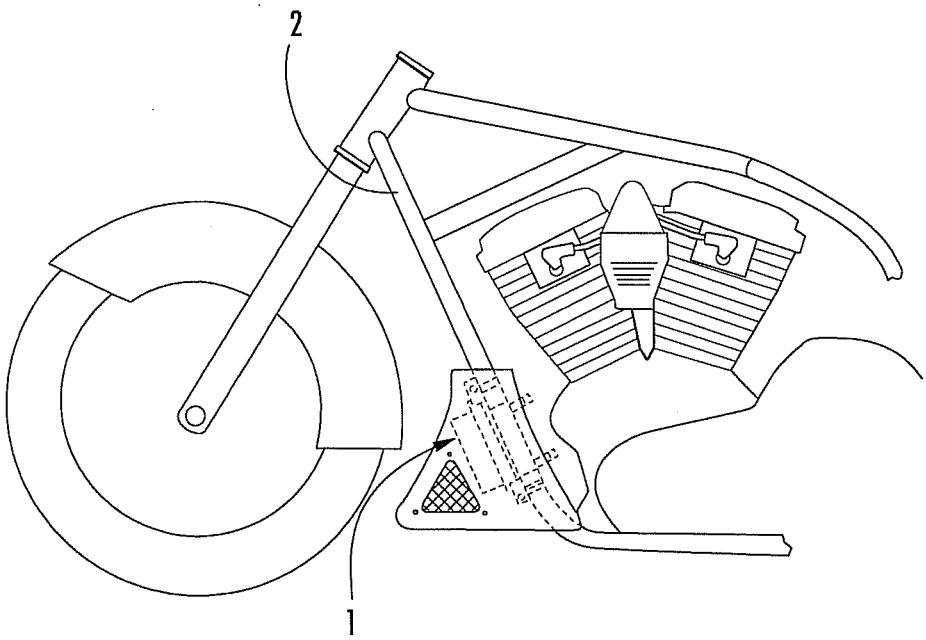
FIG. 13 (PRIOR ART)
FIG. 13 is a side view of a motorcycle having the oil cooler of FIGS. 10-12.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

The present invention relates to a cooler for a motorcycle. The cooler generates an air flow and may be particularly advantageous in cooling a fluid flow, such as oil or water. In the case of an oil cooling system, the invention is preferably a continuous airflow oil cooling system (CAOCS), through which oil is constantly passing and being cooled when a motorcycle's engine is running.

The oil cooling system of the present invention will cool a motorcycle's engine oil just as well when the motorcycle's engine is running and the motorcycle is sitting still, as it does when the motorcycle is in motion. Further, the oil cooling system of the present invention is virtually invisible to an observer of the motorcycle, as it is incorporated into a primary drive (such as the type usually seen on modern V-twin powered motorcycles).

Figure 14:
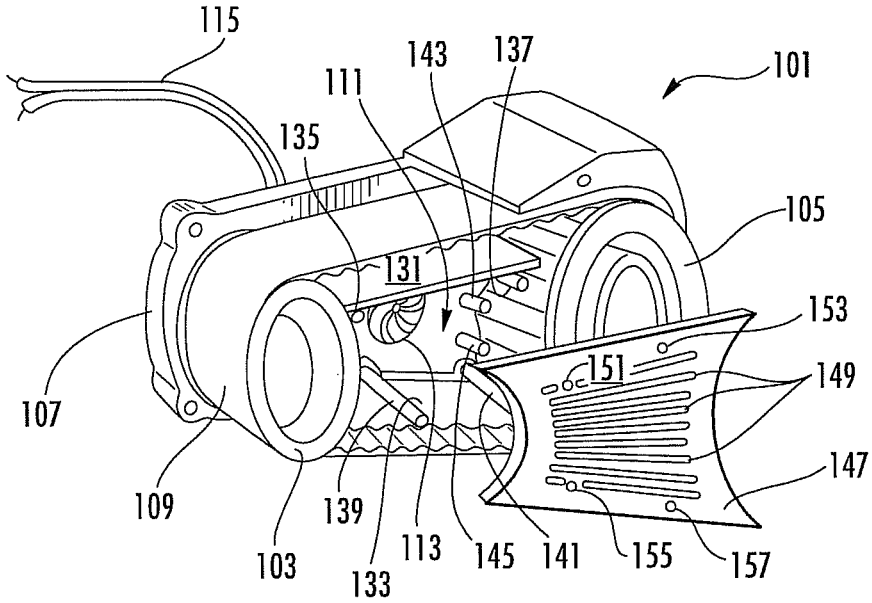
FIG. 14 is a perspective view of a primary drive of a motorcycle for accommodating an oil cooler, in accordance with the present invention.
Figure 17:
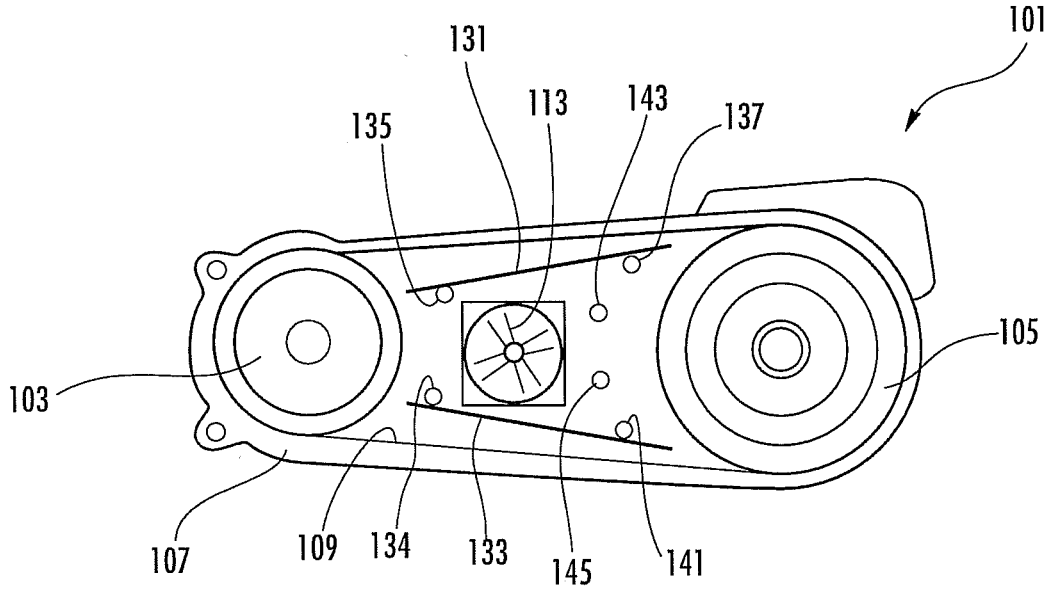
FIG. 17 is a side view of the primary drive of FIG. 14 with the heat exchanger removed.

FIG. 14 is a perspective view of a primary drive 101 of a motorcycle with a cover plate 147 spaced therefrom in an exploded view. FIG. 17 is a side view of the primary drive 101 without the cover plate 147.

As illustrated in FIGS. 14 and 17, the primary drive 101 includes an engine pulley 103 and a clutch pulley 105. A base plate 107 is located behind and between the engine pulley 103 and the clutch pulley 107. A drive belt 109 loops around the engine pulley 103 and the clutch pulley 105.

A "dead space" or open area 111 (See FIG. 14) exists between the engine pulley 103 and the clutch pulley 105. A fan 113 is mounted to the base plate 107. The fan 113 pulls or pushes an air flow through the open area 111 of the primary drive 101. To the right of the fan 113 on a front side of the base plate 107 are an oil outlet coupling 143 and an oil inlet coupling 145. The oil outlet coupling 143 and oil inlet coupling 145 would be connected to oil lines on a backside of the base plate 107 and ultimate tied into a conventional oil circulation system of the engine of the motorcycle.

A first vectoring vane 131 exists at a top of the open area 111. A second vectoring vane 133 exists at a bottom of the open area 111. First and second screw receiving bosses 135 and 137 reside below the first vectoring vane 131. Third and fourth screw receiving bosses 139 and 141 reside above the second vectoring vane 133.

The cover plate 147 is sized and shaped to cover the open area 111 between the engine pulley 103 and the clutch pulley 105. The cover plate 147 includes vents 149 formed therein. First, second, third and fourth through holes 151, 153, 155 and 157 are provided in the cover plate 147 and arranged so as to align with the first, second, third and fourth threaded bosses 135, 137, 139 and 141, respectively, and so as to each accept a threaded fastener, such as a screw, bolt or specialty fastener, such that the cover plate 147 may be secured to the primary drive 101.

Figure 15:
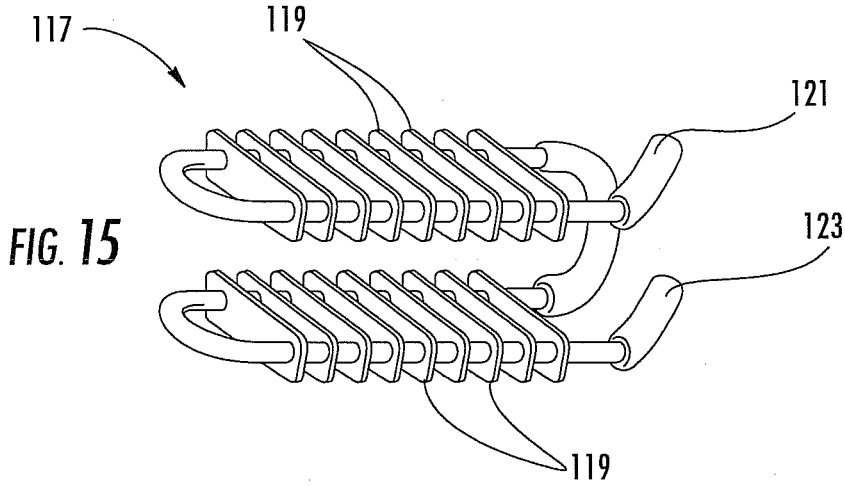
FIG. 15 is a perspective view of a heat exchanger for placement within the primary drive of FIG. 14, in accordance with a first embodiment of the present invention.

FIG. 15 illustrates a first embodiment of a heat exchanger 117. In FIG. 15, the heat exchanger 117 includes a four pass coil which includes heat fins 119. One end of the heat exchanger 117 constitutes an oil inlet 121, while the other end of the heat exchanger 117 constitutes an oil outlet 123.

Figure 16:
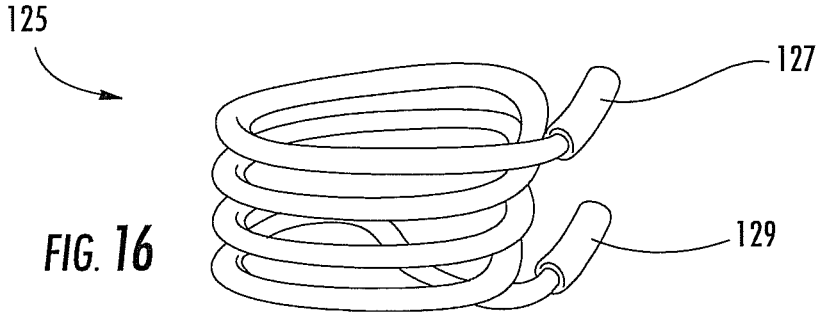
FIG. 16 is a perspective view of a heat exchanger for placement within the primary drive of FIG. 14, in accordance with a second embodiment of the present invention.

FIG. 16 illustrates a second embodiment of a heat exchanger 125. In FIG. 16, the heat exchanger 125 includes an eight pass coil which does not include heat fins. One end of the heat exchanger 125 constitutes an oil inlet 127, while the other end of the heat exchanger 125 constitutes an oil outlet 129.

Figure 18:
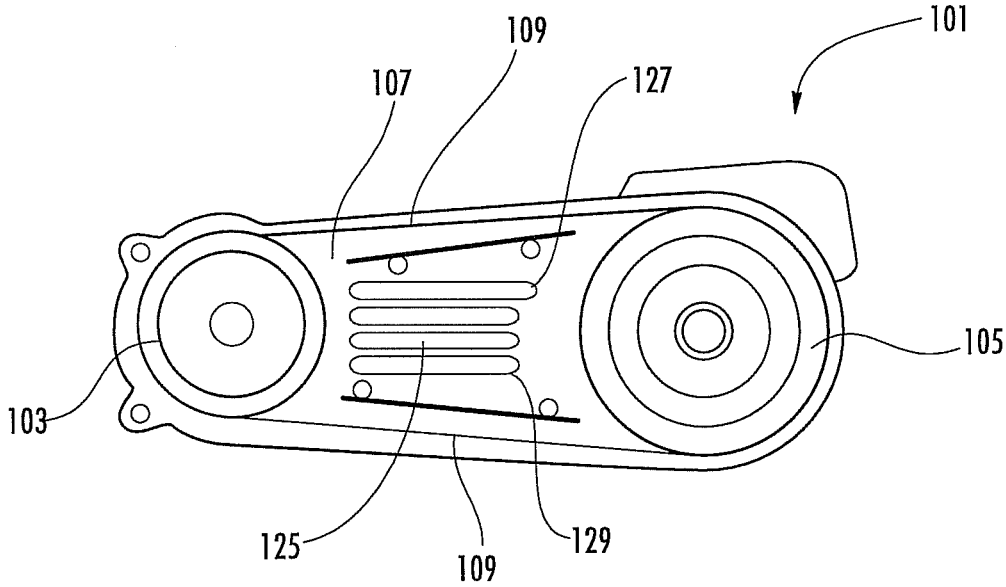
FIG. 18 is a side view of the primary drive of FIG. 14 with the heat exchanger installed.
Figure 19:
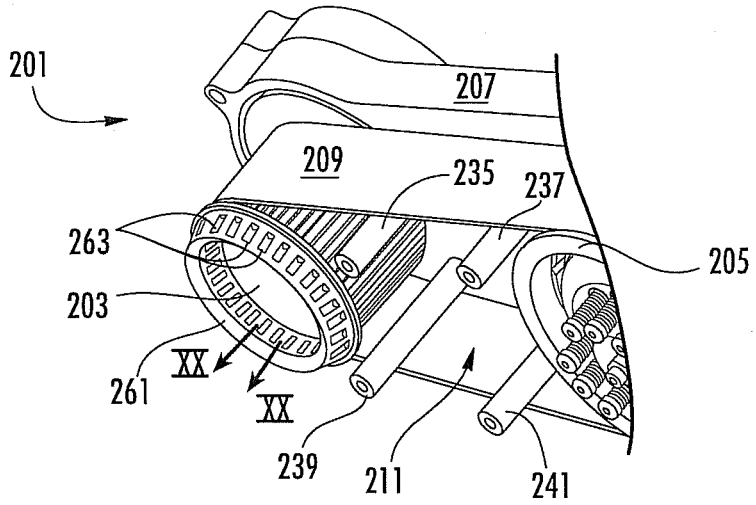
FIG. 19 is a perspective view of a modified primary drive component functioning as a fan, in accordance with an optional embodiment of the present invention.
Figure 20:
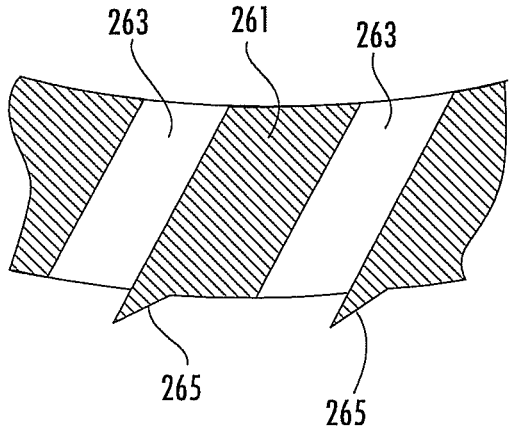
FIG. 20 is a cross sectional view taken along line XX-XX in FIG. 19.

FIG. 18 is a side view of the primary drive 101, similar to FIG. 17, however FIG. 18 illustrates the heat exchanger 125 of FIG. 16 installed into the open space 111 of the primary drive 101. The oil inlet 127 of the heat exchanger 125 is connected to the oil outlet coupling 143 and the oil outlet 129 of the heat exchanger 125 is connected to the oil inlet coupling 145. Finally, the cover plate 147 would be installed, such that the heat exchanger 125 would be located between the base plate 107 and the cover plate 147.

The heat exchanger 125 would be positioned within an air flow generated by the fan 113. The first and second vectoring vanes 131 and 133 would act to evenly direct the air flow through the heat exchanger 125 and would also shield and protect the drive belt 109 from the heat radiating from the heat exchanger 125. During operation, the heat exchanger 125 would transfer heat from the oil of the motorcycle's engine to the air flow.

In operation, the fan 113 may be thermostatically controlled to operate only when needed or may be continuously operated when the motorcycle's engine is running. The fan 113 may be electrically powered, such as by wires 115 (See FIG. 14), or mechanically powered. Preferably, the electrically powered fan 113 is activated by a thermal switch and is engaged only above a predetermined threshold temperature (e.g., at around 180 degrees Fahrenheit). An electrically powered fan 113 would derive power from the motorcycle's battery.

An alternative, mechanically powered fan would derive power from the motion of one of the engine's components, e.g., a pulley or gear system interconnecting the mechanically powered fan to the rotational power of the engine pulley 103. The pulley or gear system could include a heat sensitive clutch, such that the rotation of the mechanically powered fan starts above a threshold temperature and/or a rotational speed of the mechanically driven fan increases with temperature.

Air may be drawn in by the fan 113 from the backside of the base plate 107 and blown across the heat exchanger 125 to exit via the vents 149 in the cover plate 147. Alternatively, air may be drawn in by the fan 113 through the vents 149 in the cover plate 147 and through the heat exchanger 125 to be blown out the backside of the base plate 107.

FIGS. 14 and 17 have illustrated the fan 113 as being attached within a through hole in the base plate 107. In an alternative embodiment, the fan 113 is attached to the cover plate 147, behind the vents 149, and another series of vents are provided in the base plate 107 or a hole is provided in the base plate 107 to allow air to pass therethrough. With this arrangement, air is either drawn in through the vents 149 of the cover plate 147, or blown out through the vents 149 in the cover plate 147, depending upon the rotation direction of the fan 113.

FIGS. 19-22 illustrate an oil cooler in accordance with an optional embodiment of the present invention. A primary drive 201 includes an engine pulley 203 and a clutch pulley 205. A base plate 207 is located behind and between the engine pulley 203 and the clutch pulley 207. A drive belt 209 loops around the engine pulley 203 and the clutch pulley 205.

Figure 22:
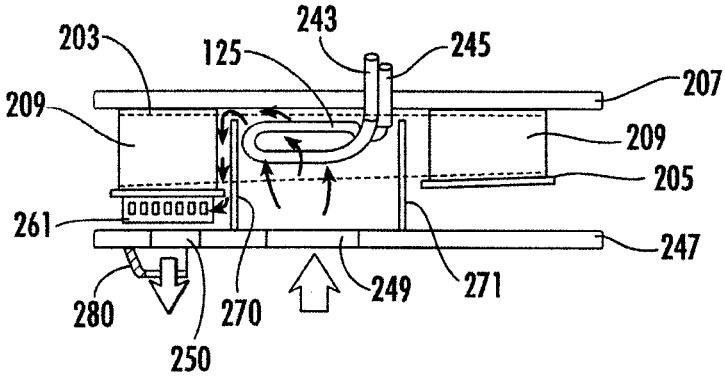
FIG. 22 is a schematic view illustrating an air flow through the primary drive of FIG. 19.

A "dead space" or open area 211 exists between the engine pulley 203 and the clutch pulley 205. As best seen in FIG. 22, on the right side of the open area 211 on a front side of the base plate 207 are an oil outlet coupling 243 and an oil inlet coupling 245 (identical to the oil outlet coupling 143 and oil inlet coupling 145 of FIGS. 14 and 17). The oil outlet coupling 243 and oil inlet coupling 245 would be connected to oil lines on a backside of the base plate 207 and ultimate tied into a conventional oil circulation system of the engine of the motorcycle.

Vectoring vanes could optionally be positioned above and below the open space 211 (like the vectoring vanes 131 and 133 of FIGS. 14 and 17). First, second, third and fourth screw receiving bosses 235, 237, 239 and 241 extend away from the base plate 207.

Figure 21:
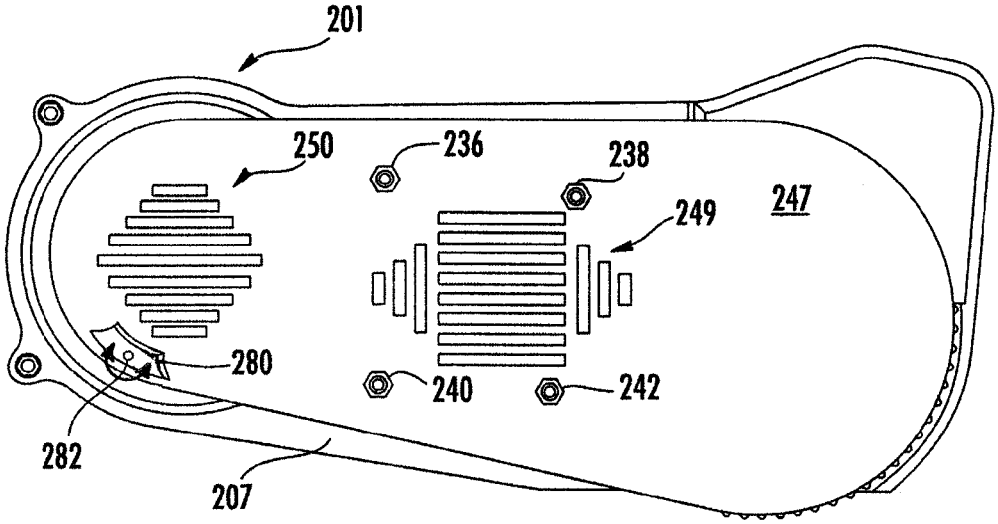
FIG. 21 is a side view illustrating the primary drive of FIG. 19 with a cover plate installed.

A cover plate 247 is sized and shaped to cover the open area 211, the engine pulley 203, and the clutch pulley 205, as best seen in FIG. 21. The cover plate 247 includes first vents 249 formed in a mid section thereof and second vents 250 formed near a left side thereof, overlying the engine pulley 203. First, second, third and fourth through holes are provided in the cover plate 247 and arranged so as to align with the first, second, third and fourth threaded bosses 235, 237, 239 and 241, respectively, and so as to each accept a threaded fastener 236, 238, 240 and 242, such as a screw, bolt or specialty fastener, such that the cover plate 247 may be secured to the primary drive 201.

As best seen in FIG. 22, the heat exchanger 125 of FIG. 16 has its oil inlet 127 connected to the oil outlet coupling 243 of the base plate 207 and its oil outlet 129 connected to the oil inlet coupling 245 of the base plate 207.

The engine pulley 203 is slightly extended in width, beyond the width of the drive belt 209, to create a small extended edge 261 on the engine pulley 203. The small extended edge 261 includes a plurality of through slots 263 (e.g., twenty six through slots 263). Each through slot 263 is angled as it passes through the extended edge 261, as best seen in the cross sectional view of FIG. 20. Optionally, air collectors 265 may be attached to one or both ends of the through slots 263 (outside of extended edge 261 and/or inside of extended edge 261) to assist in catching air. When the cover plate 247 is installed, the first vents 249 overlie the heat exchanger 125 and the second vents 250 overlie the center of the engine pulley 203.

By the arrangement of FIGS. 19-22, a portion of the engine pulley 203, i.e., the extended edge 261, effectively becomes a squirrel cage-type fan/blower, which can be used to pull or push air through the open space 211 within the primary drive 201 (dependent upon the angle direction of the through slots 263 and the direction of rotation of the engine pulley 203). For example, in FIG. 22 air would be drawn in through vents 249, through the heat exchanger 125, around a back edge of a left side vectoring vane 270 (which is attached to a backside of the cover plate 247), along the exposed outer circumference of the engine pulley 203 (where the belt 209 does not overlap the engine pulley 203), through the through slots 263 in the extended edge 261 of the engine pulley 203, and blown out the center of the engine pulley 203 and through the second vents 250 of the cover plate 247. One or more additional vectoring vanes 271 may be attached to either the front side of the base plate 207 or the back side of the cover plate 247 to block air from entering the dead space 211 other than via the first vents 249.

Although FIGS. 19-22 illustrate a modified engine pulley 203, it would also be possible to modify the clutch pulley 205 in a like manner to form a squirrel cage fan on an extended outer edge of the clutch pulley 205. Further, it would be possible to modify the drive belt 209 to form a fan. A modified drive belt 209 would have slightly angled inner teeth to engage slightly angled receiving grooves of the engine pulley 203 and clutch pulley 205. Small openings or perforations could be provided in sequences between the teeth of the belt 209. In this instance, the belt 209, itself, would act as a squirrel cage fan to push or pull air through the openings or perforations in the belt 209.

Although the extended edge 261 of the engine pulley 203 has been illustrated for the purpose of drawing air through the heat exchanger 125, it may be desirable to employ such a dual purpose engine pulley 203 regardless of the presence of the heat exchanger 125 within the primary drive 201. The air flow exiting the second vents 250 could be most desirable to provide a high speed cool air flow to the feet and lower legs of the motorcycle rider. When stuck in traffic, the radiant engine heat adjacent to a rider's feet and legs can be most uncomfortable. The air circulation provided by the squirrel cage fan at the extended edge 261 of the engine pulley 203 could provide a welcome air flow to the feet and legs of the rider to improve the rider's comfort.

To this end, a deflector 280 could be attached to the motorcycle (e.g., the cover plate 247), located proximate the exiting air flow generated by the engine pulley 203, to direct the air flow up the rider's leg. Optionally, the. deflector 280 could be mounted to a speed sensitive pivoting controller (e.g., a shaft of a servo 282, as commonly known in the art of remote control planes), so as to move the deflector 280 to direct the air flow up or toward the rider's leg only during a slow speed or stopped condition of the motorcycle. During high speed driving of the motorcycle, the deflector 280 could direct the air flow away from the rider to avoid any annoyance. The structure and fabrication of such speed-controlled, moveable air deflectors are known in the automotive arts (e.g., the speed based moving whale tail of a Porsche 911). However, such moving deflectors have been previously used for aerodynamic performance of the vehicle rather than rider comfort purposes.

While the heat exchangers 117 and 125 have been described as handling oil, the heat exchangers 117 and 125 could alternatively handle water or a water/antifreeze mixture for a water cooled engine, or other liquids or gases. Further, the heat exchangers 117 and 125 may take other forms besides those illustrated, e.g. a five pass heat exchanger, a ten pass heat exchanger, a heat exchanger with vertical coils, a heat exchanger with horizontal coils.

Although the oil cooler has been described and illustrated as an original equipment device to be installed on a motorcycle's primary drive as initially built, it is to be understood that the parts described herein could be packaged as retro fit kit for an existing primary drive.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A motorcycle fluid cooler comprising:

a motorcycle primary drive, wherein said motorcycle primary drive includes an engine pulley and a clutch pulley;

a fan for pulling or pushing an air flow through a portion of said motorcycle primary drive; and a heat exchanger for containing a motorcycle fluid located in said portion of said motorcycle primary drive and within said air flow, wherein said fan is electrically powered by an electric motor and wherein said heat exchanger and fan occupy an inside area between said engine pulley and the clutch pulley.

2. The motorcycle fluid cooler of claim 1, wherein said motorcycle primary drive includes a plate intermediate said engine pulley and said clutch pulley, and wherein said fan is mounted to said plate.

3. The motorcycle fluid cooler of claim 2, wherein said plate is either a base plate or a cover plate.

4. The motorcycle fluid cooler of claim 1, further comprising:

vectoring vanes within said motorcycle primary drive which direct the air flow to said heat exchanger.

5. The motorcycle fluid cooler of claim 1, wherein said heat exchanger transfers heat from oil of the motorcycle to the air flow.

6. A motorcycle fluid cooler comprising:

a motorcycle primary drive including an engine pulley and a clutch pulley, and a base plate located between said engine pulley and said clutch pulley;

a fan mounted to said base plate; and a heat exchanger for containing a motorcycle fluid wherein said heat exchanger and fan occupy an inside area between said engine pulley and the clutch pulley and wherein said fan is electrically powered by an electric motor.

7. The motorcycle fluid cooler of claim 6, further comprising:

a cover plate attached to said motorcycle primary drive, wherein said heat exchanger is located between said base plate and said cover plate; and vents formed in said cover plate.

8. The motorcycle fluid cooler of claim 7, further comprising:

vectoring vanes located within said motorcycle primary drive which direct air from said fan through said heat exchanger.

9. The motorcycle fluid cooler of claim 6, wherein said fan generates an air flow, and wherein said heat exchanger transfers heat from oil of the motorcycle to the air flow.

10. A motorcycle fluid cooler comprising:

a motorcycle primary drive including an engine pulley and a clutch pulley, a belt connecting said engine pulley and said clutch pulley;

a fan, wherein said fan pulls or pushes the air flow through a portion of said motorcycle primary drive; and a heat exchanger located within said motorcycle primary drive and in the air flow wherein said heat exchanger and fan occupy an inside area between said engine pulley and the clutch pulley, wherein said heat exchanger transfers heat from oil of the motorcycle to the air flow, wherein said fan also causes the air flow to be directed away from said motorcycle primary drive wherein said fan is electrically powered by an electric motor.

11. The motorcycle fluid cooler of claim 10, further comprising:

a deflector mounted in a path of the air flow to divert the air flow in a different direction.

12. The motorcycle fluid cooler of claim 11, wherein said deflector is movable, such that the direction of the diverted air flow can be changed by moving said deflector.

13. The motorcycle fluid cooler of claim 12, wherein said deflector is moved dependent upon a speed of the motorcycle.

* * * * *